US009423142B2

(12) United States Patent
Lee

(10) Patent No.: US 9,423,142 B2
(45) Date of Patent: Aug. 23, 2016

(54) PERSONAL PORTABLE HUMIDIFIER-TYPE AIR CLEANER, AND CASE AND WATER TANK THEREOF

(76) Inventor: Seung Hyun Lee, Iksan-si (KR)

( * ) Notice: Subject to any disclaimer, the term of this patent is extended or adjusted under 35 U.S.C. 154(b) by 1095 days.

(21) Appl. No.: 13/508,342

(22) PCT Filed: Nov. 1, 2010

(86) PCT No.: PCT/KR2010/007593
§ 371 (c)(1),
(2), (4) Date: May 30, 2012

(87) PCT Pub. No.: WO2011/059196
PCT Pub. Date: May 19, 2011

(65) Prior Publication Data

US 2012/0241987 A1 Sep. 27, 2012

(30) Foreign Application Priority Data

Nov. 11, 2009 (KR) ..... 10-2009-0108565

(51) Int. Cl.

| | |
|---|---|
| ***F24F 3/14*** | (2006.01) |
| ***F24F 6/04*** | (2006.01) |
| *F24F 3/16* | (2006.01) |
| *F24F 6/00* | (2006.01) |

(52) U.S. Cl.
CPC ..... *F24F 6/043* (2013.01); *F24F 3/1603* (2013.01); *F24F 2003/1657* (2013.01); *F24F 2006/008* (2013.01); *F24F 2221/12* (2013.01)

(58) Field of Classification Search
CPC ..... F24F 3/1603; F24F 6/043; F24F 2003/1657; F24F 2006/008; F24F 2221/12
USPC ..... 261/72.1, 104, 107, 119.1, DIG. 65
See application file for complete search history.

(56) References Cited

U.S. PATENT DOCUMENTS

| | | | | | |
|---|---|---|---|---|---|
| 1,769,071 | A * | 7/1930 | Raney | F02M 35/024 | 261/104 |
| 1,879,358 | A * | 9/1932 | Lilly | F02M 17/28 | 261/104 |
| 2,095,451 | A * | 10/1937 | Reynolds | F24F 6/043 | 261/103 |
| 2,596,801 | A * | 5/1952 | Wilhelmi | F24F 7/013 | 261/30 |
| 3,045,450 | A * | 7/1962 | Chandler | F24F 6/04 | 261/104 |
| 4,365,952 | A * | 12/1982 | Ohmukai | F23D 3/40 | 239/138 |
| 4,419,302 | A * | 12/1983 | Nishino | F22B 1/284 | 122/487 |
| 5,609,296 | A * | 3/1997 | Imamura | F24F 3/044 | 165/DIG. 171 |
| 5,916,493 | A * | 6/1999 | Miller | A61M 16/1075 | 128/204.13 |
| 6,726,749 | B2 * | 4/2004 | Peteln | B01D 45/10 | 261/103 |

FOREIGN PATENT DOCUMENTS

JP 9-250785 * 9/1997

* cited by examiner

*Primary Examiner* — Charles Bushey
(74) *Attorney, Agent, or Firm* — John K. Park; Park Law Firm

(57) ABSTRACT

A personal portable humidifier-type air cleaner includes: a portable case; a water tank formed in the case to store a certain amount of water; an intake channel for outside air, which is connected from outside to inside the case; an air discharge channel configured in continuation of the intake channel, for discharging the inside air to outside the case via a directional exit; a fan disposed on the intake channel, for forcing the air to flow from the intake channel to the discharge channel; and a vaporization kit composed of a plurality of moisture-containing filters that is maintained in a moisture-containing condition by being arranged on the air discharge channel and connected with the water tank by a wick.

4 Claims, 6 Drawing Sheets

PERSONAL PORTABLE HUMIDIFIER-TYPE AIR CLEANER, AND CASE AND WATER TANK THEREOF

TECHNICAL FIELD

The present invention relates to a personal and portable humidifier type air cleaner which is personally carried or mounted on a vehicle and, more particularly, to a personal and portable humidifier type air cleaner, and a casing and a water tank thereof, which supplies personal humidified and clean air in an open space by discharging the humidified and clean air through a directional exit formed in the casing via a vaporization kit that is formed to maintain a moisture-containing condition and is formed of a plurality of moisture-containing filters.

BACKGROUND ART

Pollutants, such as exhaust gases from vehicles, such as sulfur oxides or nitrogen oxides, fine particles generated when production facilities are operated, and volatile organic compounds generated from various kinds of industrial products, become the cause of a chest complaint, a chronic pulmonary disease, and atopic disease.

Furthermore, dry indoor air causes mucous membrane xerosis and xerophthalmia, becomes the cause of a cold, bronchial asthma, and a nasal inflammation, and reduces the function of metabolism. Accordingly, an immune-enhancing effect is reduced, and fine particles are raised and spread, thereby propagating a virus riding on the fine particles.

The pollutants, such as fine particles, are commonly filtered by an air cleaner of a filtering method using a filter. This method has reached the limit in removing toxic element and had the limit that is unable to satisfy a humidity condition, that is, an essential element of a pleasant environment.

For the reasons above, a humidifier air cleaner and a portable humidifier according to a VENTA® method are recently being actively spread.

The humidifier air cleaner according to the VENTA® method has a structure in which a shaft on which several tens of disks are mounted is installed in a water tank, the lower parts of the disks are rotated with them being immersed into water, intake air passes through over the disks in order to wash air through contact between air and a water screen formed on a surface of the disks, thereby adsorbing and filtering pollutants included in air and controlling indoor humidity by vaporizing and humidifying water. The humidifier air cleaner according to the VENTA® method has a simple structure, including a fan configured to suck air, the disk shaft rotated while operating in conjunction with the rotation of the fan, and a water tank, and provides advantages in that it may effectively filter and separate pollutants, such as fine particles, through the adsorption and solubility of water and maintain reasonable indoor humidity through vaporization and humidification, that is, a principle that humidification is performed according to relative humidity. However, the humidifier air cleaner according to the VENTA® method is problematic in that the humidifier air cleaner is not suitable for a moving vehicle or students and office workers who use the humidifier air cleaner while moving because it is bulky and configured to fill water in the opened water tank and the humidifier air cleaner has difficult internal sanitary management because it has relatively high humidity within the casing and includes a lot of disk structures.

The portable humidifier according to the VENTA® method includes a portable humidifier disclosed in Korean Patent Laid-Open Publication No. 10-2004-0106739 and humidifiers disclosed in Korean Patent Laid-Open Publication Nos. 10-2009-0099246 and 10-2009-0092674, in which humidification is performed by ultrasonic oscillation, such as a portable humidifier for performing humidification by ultrasonic vibration by using water contained in a container, such as a cup, without using an additional water tank for containing humidification water. Furthermore, WO2005/098323 proposes a structure having improved portability and an improved natural evaporation and humidification ability in such a manner that a humidification element is extended and modified when a casing is opened.

The humidifier using ultrasonic vibration has improved portability by separating a common ultrasonic humidifier from the water tank, but has the limit to a construction having sufficient output like a common humidifier for portability. In general, moisture particles of a spray form have a low dispersing property because they are greatly affected by gravity. Accordingly, the humidifier is problematic in that there is a danger of injury due to electromagnetic waves of high pressure for ultrasonic vibration when the humidifier is closely used and a person may have a feeling of rejection if the moisture particles of a spray form directly affect the respiratory organs. Furthermore, the humidifier is problematic in that a drop of water may propagate bacteria when a water source is polluted because the drop of water carries a virus of 0.2 to 0.3 μm in size and spreads along with the virus and humidification using ultrasonic vibration has the limit to the use of a charging battery because the humidifier has high consumption power.

The humidifier having improved portability and an improved natural evaporation and humidification ability by extending and modifying the humidification element may have excellent portability using a method of carrying the humidifier in a folded state and unfolding the humidifier and filing water when using the humidifier and pleasant humidification performance through vaporization and humidification according to relative humidity, and the humidifier is used for the humidification of one room in a hotel or independent small-sized spaces. However, the humidifier has a structure not suitable for personal proximity humidification in opened spaces, such as offices or libraries.

Meanwhile, in order to obtain a personal use effect in an air cleaner or a humidifier, Korean Patent Laid-Open Publication No. 10-0457645, WO2002/56966, and Korean Patent Laid-Open Publication No. 10-2008-0089727 provide personal cleaning air by supplying purified or humidified air to a hat, a spreader worn on the head, and a mask, but is disadvantageous in that they are inconvenient to use.

DISCLOSURE

Technical Problem

An object of the present invention is to provide a personal proximity humidifier type air cleaner capable of providing personal humidified and clean air even in opened spaces in such a manner that outside intake air comes in contact with a vaporization kit within a casing so that the outside intake air is vaporized and humidified and the vaporized and humidified air is discharged through the directional exit of the casing and then discharged toward a person by using the vaporization kit installed on the discharge channel of air, coupled to a water tank through wicks, and configured to include a plurality of moisture-containing filters maintaining a moisture-containing condition.

Furthermore, an object of the present invention is to provide a personal and portable humidifier type air cleaner, wherein air is humidified with reasonable humidity according to relative humidity in accordance with a vaporization and humidification principle and moisture particles of a molecule cluster unit are provided to a user with it carried on a gentle wind, thereby performing pleasant humidification, reducing the amount of water wasted, providing excellent humidification efficiency, and prohibiting the spread and propagation of a virus.

Furthermore, an object of the present invention is to provide a personal and portable humidifier type air cleaner casing, wherein the intake and discharge ports of air are spaced apart from each other so that the intake and discharge of air do not interfere with each other and internal elements are simply separated and coupled by rails and a one-touch fixture.

Furthermore, an object of the present invention is to provide a personal and portable humidifier type air cleaner, wherein a vaporization kit can be sanitarily managed by simply replacing the vaporization kit and the vaporization kit is configured to maintain a dry state after use.

Furthermore, an object of the present invention is to provide a humidifier type air cleaner, wherein a filter necessary to filter air is installed on an air intake channel so that moisture of a molecule cluster unit is carried on air of a clean state and then provided.

Furthermore, further yet another object of the present invention is to provide a portable humidifier type air cleaner, which has an excellent receipt property and may be used for a long time even by a small battery by minimizing the casing and the use of power through a regular hexahedron structure.

Furthermore, further sill another object of the present invention is to provide a water tank for a humidifier type air cleaner, which is capable of putting aroma and a disinfection solution into the water tank through an osmotic film.

Furthermore, still yet another object of the present invention is to provide a water tank for a humidifier type air cleaner, wherein aroma and a disinfection solution can be freely put according to user taste.

Furthermore, further another object of the present invention is to provide a water tank for a humidifier type air cleaner, which is capable of enabling replacement, increasing antibiosis, and improving sanitation by constructing the wicks formed in the water tank for the humidifier type air cleaner so that the wicks have an attachment and detachment structure.

Technical Solution

To achieve the above objects, a humidifier type air cleaner according to the present invention includes a portable casing, an airtight type water tank formed within the casing and configured to accommodate a certain amount of water and to have the accommodated water discharged externally through wicks, an intake channel of outside air coupled to the casing from the outside to the inside, an air discharge channel formed to be consecutive to the intake channel and formed to discharge inside air to the outside of the casing through an exit formed toward a user, a fan installed on the intake channel in order to force the flow of air through the discharge channel in the intake channel, and a vaporization kit formed of a plurality of moisture-containing filters which is installed on the discharge channel of air, connected to the wicks of the water tank, and formed to maintain a moisture-containing condition.

Furthermore, in the humidifier type air cleaner of the present invention, a filter for producing primary clean air by purifying intake air is provided on the intake channel, and the vaporization kit humidifies the primary clean air, thereby improving pleasantness.

Furthermore, in the humidifier type air cleaner casing of the present invention, an air intake port is formed on one side of a straight-line shape casing in which a rectangle inner space is formed, an air discharge port is formed on the other side of the straight-line shape casing, and a casing inside air intake channel and an air discharge channel form a consecutive straight-line shape, so that air can smoothly flow with the intake and discharge of the air not interfering with each other.

Furthermore, in the humidifier type air cleaner casing of the present invention, the rails are formed in the straight-line shape inner wall of the casing in the length direction so that each element is inserted into and supported by the rails and separated or coupled by a one-touch fixture.

Furthermore, in the humidifier type air cleaner of the present invention, the vaporization kit is mounted on a tray inserted into the casing, separated and replaced along with the separation of the tray, and coupled to the wicks only when humidification is performed, so that humidified water can be supplied from the water tank.

Furthermore, in the humidifier type air cleaner of the present invention, the vaporization kit and the wicks are means coupled only when humidification is performed, and a tumbler coupled to a switch lever through a two-stage cam structure is operated in conjunction with the switch lever such that a fan starting switch is turned on in a first-stage position and the fan starting switch maintains the ON state in a two-stage position. In this state, the vaporization kit descends so that the moisture-containing filters and the wicks are coupled.

Furthermore, the humidifier type air cleaner of the present invention is configured so that it is driven by a low power fan installed on the intake channel and by a storage battery, a USB power source, an adapter power source, or a power source of a combination of them configured to drive the fan.

Furthermore, the water tank for the humidifier type air cleaner of the present invention includes liquid supply means for supplying liquid, such as an aroma or disinfection solution, to the inside of the water tank.

Furthermore, in the water tank for the humidifier type air cleaner of the present invention, an additional container for containing a disinfection solution or an aroma solution is coupled to the water tank stopper of the liquid supply means, and the bottom of the container has a structure caulked by osmotic film material for continuously supplying a disinfection solution or an aroma solution to water within the container.

Furthermore, in the water tank for the humidifier type air cleaner of the present invention, the additional container for containing a disinfection solution or an aroma solution is coupled to the water tank stopper of the liquid supply means, and the disinfection solution or the aroma solution within the container is inputted by a one-touch liquid supply device.

Furthermore, in the water tank for the humidifier type air cleaner of the present invention, the wicks have an attachment and detachment structure, and a core formed of a pure copper plate is formed at the center of the wicks so that the wicks have antibiosis.

Furthermore, in the humidifier type air cleaner of the present invention, the inner wall and the stopper of the water tank are made of pure copper, and a nano-silver coating layer is formed on the inner wall and the stopper.

Advantageous Effects

The present invention can provide personal humidified and clean air even in opened spaces in such a manner that outside intake air comes in contact with the vaporization kit within the casing, thereby being vaporized and humidified, and the vaporized and humidified air is discharged through the directional exit of the casing and the vaporized and humidified clean and pleasant air is then supplied discharged toward a person.

Furthermore, according to the present invention, air maintaining reasonable humidity through vaporization and humidification is blown by a small-sized fan so that the air is directly discharged toward a user. Accordingly, personal proximity humidification and air cleaning without a feeling heterogeneity can be performed.

Furthermore, according to the present invention, air is humidified with reasonable humidity according to relative humidity in accordance with a vaporization and humidification principle, and moisture particles of a molecule cluster unit are provided to a user with it carried on a gentle wind. Accordingly, pleasant humidification is performed, a small amount of water is used, humidification efficiency is excellent, and a possibility that a virus may be spread or propagated is solved because vaporization is performed in a moisture particle form smaller than the virus.

Furthermore, in the straight-line shape casing applied to the present invention, the intake and discharge ports are spaced apart from each other so that the intake and discharge of air do not interfere with each other, internal elements are simply separated and coupled by the rails and the one-touch fixture, and the inside is exposed. Accordingly, a clean inside state can be maintained, and sanitation can be improved.

Furthermore, according to the present invention, the vaporization kit can be simply replaced, and the tumbler has the two-stage cam structure and operates in conjunction with the switch lever. Accordingly, since the wicks and the vaporization kit remain separated from each other in the OFF state and the one-stage state, a phenomenon in which inside humidity is increased by natural vaporization and humidification can be prevented. Furthermore, since the fan starting switch shifts to the ON state in the one-stage state, moisture contained in the vaporization kit is dried, and the inside maintains a dry state. Accordingly, sanitation can be improved because the occurrence of fungi due to moisture within the casing can be prevented.

Furthermore, according to the present invention, since the filters having various functions are installed on the air intake channel, there are effects in that the effect and sterilization of air or air filtering through the adsorption of toxic elements can be performed and air having improved pleasantness, together with clean air having reasonable humidity controlled according to relative humidity, can be directly provided to a user.

Furthermore, the present invention can be driven by a USB and an adapter and by a charging battery or a dry cell, and only the small-sized fan having low power and low noise is configured to consume power. Accordingly, portable performance can be improved because a long-term use is possible even by a dry cell or a charging battery.

Furthermore, the present invention can provide an aroma therapy effect suitable for a personal taste by putting an aroma or disinfection solution to the inside of the water tank through the osmotic film or using the one-touch liquid supply device. Furthermore, a minutely supplied disinfection solution improves the sanitation of internal elements, and the pure copper container or the nano-silver coating film prevents an increase of contact bacteria and improves sanitation by providing a sterilization effect.

Furthermore, the wicks of the present invention achieve antibiosis because it is made of antibiosis fiber. In addition, since the pure copper plate core is formed, copper ions erupted into a wet atmosphere are combined with protein of fungi, thus destructing cells and prohibiting or destructing an increase of fungi. Accordingly, sanitation can be improved. Furthermore, a reduction of performance can be prevented because the wicks can be freely replaced.

MODE FOR INVENTION

Figure 1:
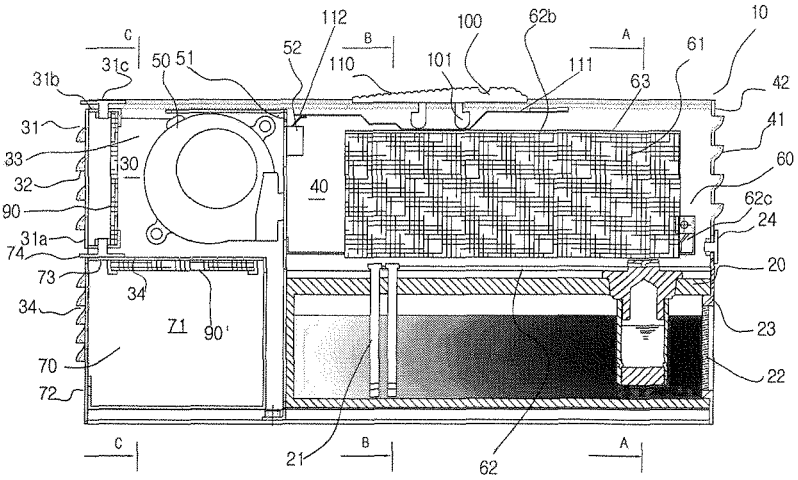
FIG. 1 shows the construction of a personal and portable humidifier type air cleaner according to the present invention.
Figure 2:
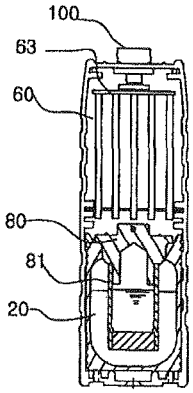
FIG. 2 is a sectional view of a portion A-A of FIG. 1.
Figure 3:
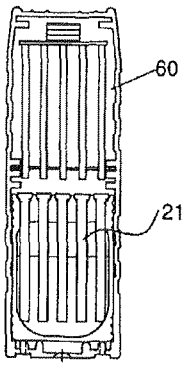
FIG. 3 is a sectional view of a portion B-B of FIG. 1.
Figure 4:
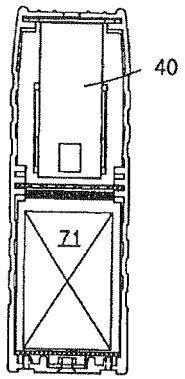
FIG. 4 is a sectional view of a portion C-C of FIG. 1.
Figure 5:
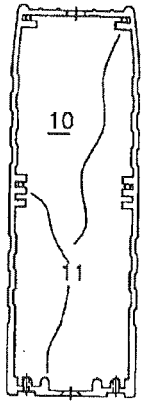
FIG. 5 shows the construction of the casing of the personal and portable humidifier type air cleaner according to the present invention.

Hereinafter, the present invention is described in detail in connection with embodiments with reference to the accompanying drawings.

FIGS. 1 to 4 show a preferred embodiment of the present invention. A humidifier type air cleaner according to the present invention includes a portable casing 10, a water tank 20 formed to accommodate a certain amount of water within the casing, an intake channel 30 of outside air coupled to the casing 10 from the outside to the inside, an air discharge channel 40 consecutive to the intake channel and formed to discharge inside air to the outside of the casing through a directional discharge exit 41, a fan 50 installed on the intake channel in order to force the flow of air through the discharge channel in the intake channel, and a vaporization kit 60 formed of a plurality of moisture-containing filters installed on the discharge channel of air, connected to the wicks 21 of the water tank 20, and formed to maintain a moisture-containing condition.

The casing 10 has a straight-line shape casing structure having a rectangular internal space formed therein and has an air intake port formed on one side and an air discharge port formed on the other side. The air intake channel and the air discharge channel within the casing form a consecutive straight-line shape, thus providing an internal space so that the intake and discharge of air can smoothly flow without interfering with each other.

In the casing 10 according to the embodiment, a plurality of rails 11 is formed at the top, bottom, and middle parts of the inner wall of the straight-line shape casing in the length direction.

The rails 11 performs a function so that the vaporization kit 60, the water tank 20, a barrier rib 51 for fixing the fan 50, and a charging battery box 70 can be inserted into and coupled to the rails in a cartridge structure and separated from the rails. Furthermore, the rails enable a cover of various forms, coupled to both sides of the casing, fixed by pieces or coupled by a one-touch fixture.

Figure 6:
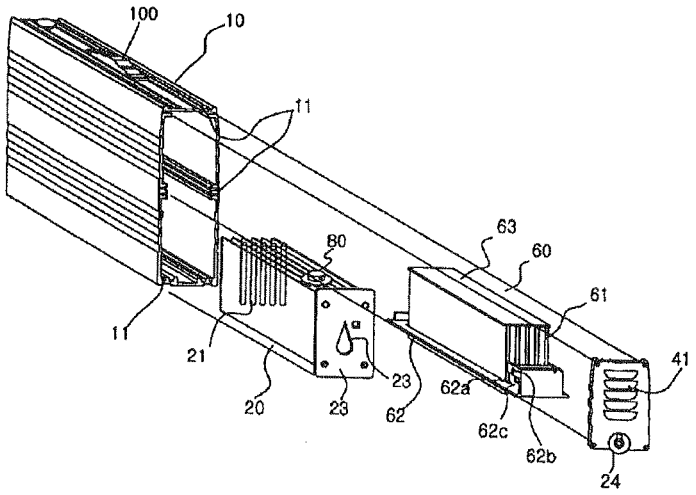
FIG. 6 shows the assembly construction of a water tank and a vaporization kit.

FIG. 6 shows a state in which the vaporization kit 60 and the water tank 20 are inserted into and coupled to the rails 11 of the casing in a cartridge form and then fixed by a reasonable cover 42. The casing structure of the humidifier type air cleaner may have a thickness of about 4 cm, height of about 11 cm, and a length of about 21 cm, which correspond to about ½ to ⅓ of a university teaching material in size and which can be simply accommodated in a bag. If the humidifier type air cleaner having the above size is placed on a desk, etc., the air discharge port is spaced apart by about 30 to 40 cm from the height of an eye. In this case, portability is satisfied in external appearance, interference according to the intake and discharge of air can be prevented because the air intake port and the air discharge port may be formed on both sides in a straight-line shape in terms of structure, and the flow of air can be smoothly induced, the flow of air is stabilized, and the occurrence of noise is reduced by the small-sized fan of low power because an air channel can be formed within the casing in a straight line. Above all, there is an effect that humidification and air cleaning performance can be improved because the time that the vaporization kit comes in contact with air and an area where the vaporization kit comes in contact with air are maximized.

The water tank 20 is a reservoir water device for supplying water to the vaporization kit 60 and is configured to have capacity capable of storing a certain amount of water, preferably, an amount of water consumed for vaporization when of the humidifier type air cleaner continues to be operated for 24 hours.

The water tank 20 is limited by the internal shape of the casing. In an illustrated embodiment, the inside of the water tank 20 accommodated in the internal space of the casing forms a sealed rectangle, the top of the water tank is opened and closed by a stopper 80, and the plurality of wicks 21 is formed in the inside of the water tank so that the ends of the wicks are exposed to a top surface of the water tank.

The inside corners of the water tank are rounded so that the inside of the water tank exposed when the stopper is opened can be easily cleaned. In order to prevent an increase of aquatic bacteria adhered to the wall body of the water tank, a surface of the inner wall of the water tank is coated with nano-silver. Nano-silver functions to preclude microbes from propagating by changing the DNA structures of the microbe so that the microbes are not increased.

The wicks 21 function to suck up moisture within the water tank by osmotic pressure and to transfer the moisture to the vaporization kit when being coupled to the vaporization kit.

The wicks can prevent kinds of mold from being parasitic on the wicks in the stop state for a long term if the wicks are made of antibiosis fiber. Furthermore, when the wicks are combined with the water tank in an attachment and detachment structure, the wicks can be periodically replaced. Since a pure copper plate core is formed within the wicks, bacteria are actively destructed by a combination of copper ions, erupted from pure copper, and protein of fungi. Accordingly, an increase of fungi is prohibited or destructed, thereby being capable of further improving sanitation.

Figure 7:
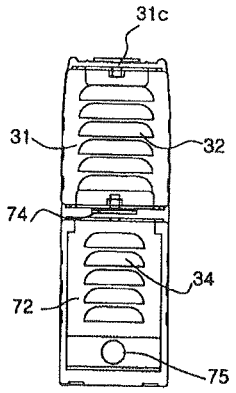
FIG. 7 shows the construction of a right side part according to an embodiment of the present invention.
Figure 10:
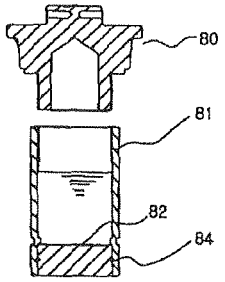
FIGS. 10 and 11 show embodiment of liquid supply means.

FIGS. 7 and 10 show embodiments of the wick. A wick insertion groove 211 having a long hole is formed in the horizontal section at the top of the rear of the water tank 20. A core 212 formed of a pure copper plate is formed at the center of the wick, and antibiosis fiber 213 is coated on the outside of the wick in a wedge form.

The wick structure is inserted into and fixed to the wick insertion groove 211 by pressing the wick structure with the wick structure being put in the wick insertion groove 211. When the wick structure is replaced, the wick structure can be easily separated from the wick insertion groove by pulling the wick structure from the wick insertion groove using a simple tool. Even when the wicks are in the moisture-containing state, contamination due to fungi can be prevented by self-antibiosis and the sterilization ability of pure copper.

A transparent window 23 is formed in a side plate 22 exposed outside the casing of the water tank so that the remaining amount of water within the water tank can be easily checked.

The water tank is coupled to the casing by the one-touch fixture 24 so that the water tank can be simply separated from the casing.

Figure 8:
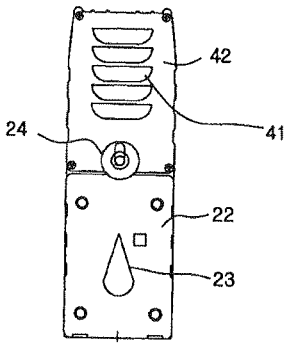
FIG. 8 shows the construction of a left side part according to an embodiment of the present invention.
Figure 9:
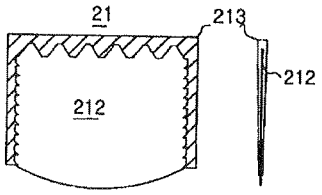
FIG. 9 shows an embodiment of wicks according to the present invention.

The one-touch fixture 24 may have various forms. In the embodiment shown in FIG. 8, the one-touch fixture 24 is closely adhered to the side cover 42 of the vaporization kit that is screwed on to the casing by a screw on the upper part of the side plate 22 of the water tank 20, thereby forming a disk that ascends and descends while being closely adhered to the side cover 42. When the disk descends, the disk engages the side plate 22 of the water tank, so that the water tank is fixed. When the water tank is sought to be separated, the water tank can be freely detached by raising the disk.

The wicks of the water tank are externally exposed, but when the stopper 80 is closed, the water tank maintains an airtight state, and thus water within the water tank does not flow externally while moving. Accordingly, according to the present invention, humidification and air cleaning are possible while talking, and the humidifier type air cleaner can be mounted on a vehicle using a proper mounting device.

Liquid supply means for supplying liquid, such as an aroma or disinfection solution, to the inside of the water tank is formed in the water tank applied to the humidifier type air cleaner.

As the liquid supply means, the embodiment of FIG. 10 shows an example in which an additional container 81 is coupled to the stopper 80 of the water tank and the osmotic film material 82 is used in order to input liquid within the container to the inside of the water tank. That is, the container 81 is coupled to the bottom of the stopper 80 by a screw, and the bottom of the container is caulked by the osmotic film material 82.

The container 81 is for inputting an aroma perfume or a small amount of a disinfection solution suitable for a personal taste. Since the bottom of the container is caulked using the osmotic film material, such as wood, a small amount of liquid, such as aroma perfume put in the container when the stopper is released, is drained through the osmotic film material little by little. Accordingly, aroma remedy can be effectively performed, and a pleasant environment can be provided because a subtle aroma perfume permeates pleasant air.

Figure 11:
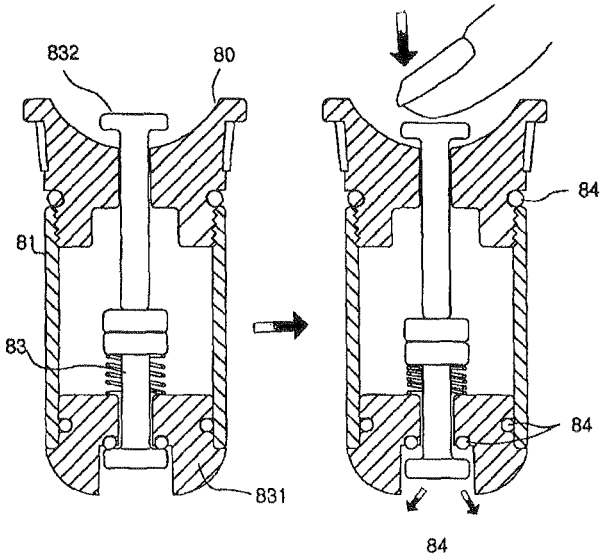
Figure 12:
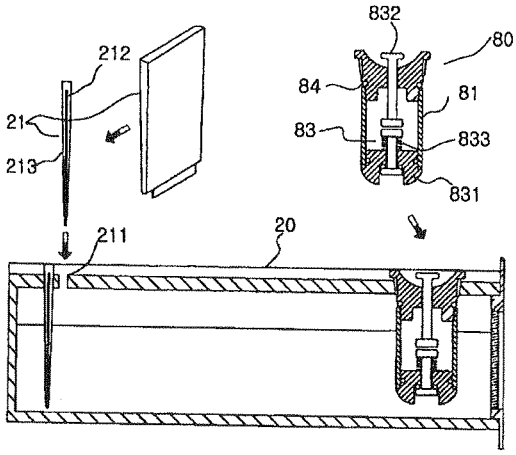
FIG. 12 shows the construction of a water tank.

FIGS. 11 and 12 show other forms of the liquid supply means and show structures in which a user can control the amount of input.

That is, the container 81 capable of receiving liquid screwed onto the bottom of the stopper 80, and a one-touch liquid supply device 83 using a valve structure is applied to the bottom of the container 81 so that liquid within the container externally flows whenever a button exposed at the top of the stopper is pressed.

The one-touch liquid supply device 83 has a structure in which the valve 831 opened when being pressed is combined with the bottom of the container 81 and the button 833 protruding to the outside through the stopper is combined with the top of the actuation pole 832 of the valve. At normal times, a spring 834 pushes up the actuation pole and thus the valve becomes a closed state. When the button is pressed, the actuation pole descends and thus the valve is opened, so that liquid, such as an aroma or antiseptic solution within the container, is flown out and then inputted to water within the water tank. Although the stopper is separated from the water tank, simple use is possible by raising up the button.

The one-touch liquid supply device 83 provides an advantage that a user having a different personal taste can control the intensity of a perfume suitable for his taste.

In the above construction, the container and the main body of the valve are made of pure copper that destructs microbe DNA of by directly affecting the microbes. Accordingly, the contamination of water within the water tank can be prevented.

The intake channel 30 of outside air corresponds to the air intake section of the outside air around the fan 50, and the discharge channel 40 corresponds to the discharge section of inside air.

The intake channel 30 of outside air includes a cover 31 formed on one side of the casing, an intake port 32 formed in the cover, and a space 33 configured to having the fan 50 within the casing installed therein.

In an illustrated embodiment, the cover 31 includes a side plate 31*a* formed to have the same shape as the side of the casing, a wing 31*b* mated with the rails 11 placed in the upper and middle parts of the casing in order to support the side plate with the side plate being inserted into the casing, and a screw 31*c* configured to fix the wing to the top of the casing. Since the intake port 32 is formed in the side plate 31*a*, outside air is introduced into the casing through the intake channel when the fan is actuated.

A filter 90, bent inwardly from both ends of upper and lower parts of the wing 31*b* and configured to provide air purification in the rear of the intake port, is installed in the wing 31*b* of the cover 31 in a cartridge form.

The filter, such as a HEPA filter for filtering fine particles or a carbon filter for providing an odor and a sterilization effect, is combined with the wing in a cartridge form, thus functioning to primarily filter and purify dust or toxic pollutants included in intake air.

In an embodiment shown in order to improve the intake ability of outside air and reduce the intake load of the fan, a second air intake port 34 is formed in the box front 72 and the top surface 73 of the charging battery box 70 having a box form so that air can be introduced via the charging battery box installed under the intake channel 30. Accordingly, the intake air through the front of the charging battery box is connected to the intake channel via a charging battery room 71, and a filter 90' is installed at the air intake port of the intake channel 30.

A charging battery is embedded in the charging battery box 90, and a disk screw 74 screwed onto the wing 31*b* of the intake cover 31 is exposed between the intake cover 31 and the box front 72. Accordingly, the charging battery box 70 can be disassembled and fixed by loosening or fastening the disk screw.

The fan 50 induces the flow of air so that air purification and vaporization and humidification are actively performed.

In an illustrated embodiment, an operating voltage of 12 V used in the fan is lowered to 5 to 6 V in order to reduce a noise level when the humidifier type air cleaner is proximately used. Furthermore, the wind pressure of the fan is reduced so that a user does not have a feeling of rejection although the wind pressure directly affects the skin or an eyeball and the respiratory organs. The portable performance of the fan has been improved by increasing the durability of the fan and reducing the power consumption of the fan.

The fan is fixed to the barrier rib 51 that partitions the intake channel and the discharge channel. The barrier rib is inserted into the rails 11 formed in the casing on the upper and lower sides and is then inserted into the casing, so that the intake channel and the discharge channel are divided on the basis of the fan. Accordingly, stable air intake according to a parallel flow is performed in the intake channel, and the vaporization kit comes in contact with air in a warm current state having relatively high contact efficiency in the discharge channel. Accordingly, the adsorption of fine particles and vaporization and humidification efficiency in the vaporization kit can be increased that much.

The vaporization kit 60 applied to the humidifier type air cleaner of the present invention functions to humidify air by vaporizing moisture in a moisture-containing condition through contact with the air and to purify discharge air by adsorbing fine particles through contact with the air.

The vaporization kit is combined in a cartridge structure so that it can be replaced. The vaporization kit has a single aggregated kit structure in which the plurality of moisture-containing filters 61 made of ultra-thin fiber on which antibiosis processing has been processed is arranged in parallel at specific intervals.

An illustrated embodiment relates to a structure in which the vaporization kit 60 is inserted into a tray 62 inserted into and detached from the rails 11 of the casing and the vaporization kit 60 is pushed into and mounted on the casing. Accordingly, the illustrated embodiment has a structure in which contact between the wicks 21 of the water tank and the vaporization kit is controlled by the switch lever 100 and the tumbler 110 having a two-stage cam 111 formed therein, while operating in conjunction with the actuation state of the fan.

To this end, a groove 62*a* is lengthily formed in the tray 62 so that the bottom of each of the moisture-containing filters 61 penetrates the groove 62*a*. A rotary shaft 62*b* for rotating and supporting one side of the vaporization kit 60 and a resilient spring 62*c* for upwardly raising the other side of the vaporization kit 60 are installed at the end of the tray 62*b* that is one side upwardly bent. A two-stage cam contact surface 63 is formed at the top of the vaporization kit 60.

One end of the tumbler 110 is fixed to the casing, and the end of the two-stage cam 111 is formed of a free stage 112 so that the free stage is connected to a fan starting switch 52, and the tumbler 110 remains contact with the two-stage cam contact surface 63 of the vaporization kit 60 that is upwardly raised by the resilient spring 62*c*. Furthermore, the switch lever 100 is combined with a slit formed at the top of the casing so that the switch level 100 slides and moves the actuation pole 101, and the humidifier type air cleaner can be operate in three types of modes OFF, DRY, and ON according to a position where the actuation pole is moved.

After the vaporization kit 60 is inserted, the cover 42 fixed to the casing by a screw is combined with the opening part of the casing, and the directional discharge exit 41 whose exit is upwardly inclined is formed in the cover. Accordingly, air flowing through the discharge channel 40 comes in contact with the vaporization kit 60, and the air is then discharged through the directional discharge exit 41 in a humidified state.

When the direction of the casing is controlled in the state in which the slant exit of the directional discharge exit 41 is placed on a desk, discharge air forms an angle of about 45 degrees by controlling with the directional discharge exit 41 being so that it is directed toward a user's face.

The vaporization kit is expendable supplies. The vaporization kit has a long separation cycle in which the vaporization kit may be replaced half yearly or yearly according to use and may be reused when the vaporization kit is dismantled, washed, and dried, if necessary. Although the cover 42 is illustrated as being fixed by a screw in the embodiment, the cover 42 may have a one-touch fixing structure. The cover 42 is configured so that the vaporization kit can be easily dismantled by separating the cover 42. The water tank 20 placed under the cover 42 can be easily separated by raiding up the one-touch fixture 24 combined with the cover 42 in an ascending and descending structure.

Figure 13:
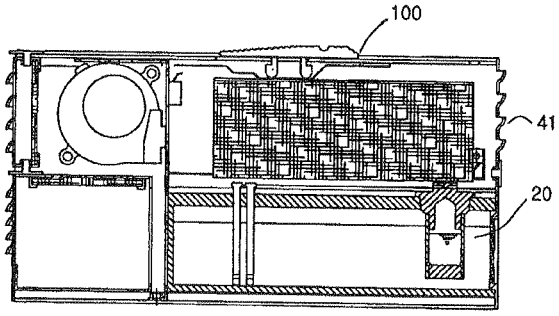
FIGS. 13 to 15 show operating states in respective modes.

FIG. 13 shows the switch lever 100 in the OFF state, in which the actuation pole of the switch lever is placed at the lowest stage of the two-stage cam. Accordingly, in the state in which the free stage 112 of the tumbler 110 does not press the fan starting switch 52, the fan is in the stop state, and the vaporization kit 60 is raised up by the action of the resilient spring, thus remaining disconnected from the wicks 21.

Figure 14:
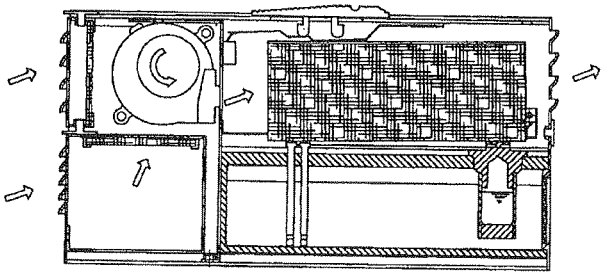

FIG. 14 shows a state in which the switch lever is forwardly pushed to the DRY position. When the actuation pole is placed in the one stage of the two-stage cam, the free stage of the tumbler downwardly falls and thus pressurizes the fan starting switch, so that the fan is actuated. Accordingly, when the pressing force of the tumbler is applied to the vaporization cartridge, and thus the vaporization cartridge is downwardly slanted, but it does not come in contact with the wicks and the vaporization kit. As described above, the DRY mode operates the fan, but moisture is not supplied to the vaporization kit. Accordingly, the fan supplies only purified air when relative humidity is high, the fan supplies aroma therapy remedy as will be described later, or the fan is used when it is sanitarily managed by drying the vaporization kit and the inside of the fan after being used in a humidification and air cleaning mode.

Figure 15:
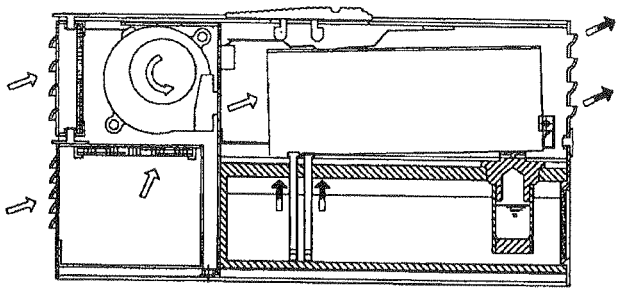

FIG. 15 shows a state in which the switch lever is advanced in the ON state. In this state, the fan starting switch is turned on to thereby drive the fan, and the actuation pole placed in the two stage of the two-stage cam downwardly pressurizes the tumbler, with the result that the actuation pole downwardly presses the vaporization kit and the wicks and the vaporization kit come in contact with each other. The moisture-containing filters 61, forming the wicks made of ultra-thin fiber and the vaporization kit, generates an excellent capillary phenomenon, and thus the vaporization kit raises up water contained in the water tank so that moisture is filled in the vaporization kit. Air pressurized by the fan forms a warm current, comes in contact with the vaporization kit so that toxic and fine particles are adsorbed and filtered, and thus discharges moisture particles of a molecule cluster unit. Accordingly, clean and pleasant air is supplied in the state in which the directional discharge exit 31 is directed toward the face of a user. Consequently, the user can breathe the pleasant air even in an opened space.

In the drawings, reference numerals not described, 75 refers to a charging jack and 84 refers to an O-ring for preventing a leakage of water.

The invention claimed is:

1. A personal and portable humidifier type air cleaner, comprising:

a portable casing;

an airtight type water tank formed within the casing and configured to accommodate a certain amount of water and to have the accommodated water discharged externally through wicks;

an intake channel of outside air coupled to the casing from the outside to the inside;

an air discharge channel formed to be consecutive to the intake channel and formed to discharge inside air to the outside of the casing through an exit formed toward a user;

a fan installed on the intake channel in order to force the flow of air through the discharge channel in the intake channel; and a vaporization kit formed of a plurality of moisture-containing filters which is installed on the discharge channel of air, connected to the wicks of the water tank, and formed to maintain a moisture-containing condition, wherein the vaporization kit is configured so that the vaporization kit is mounted on a tray inserted into the casing and is connected to the wicks of the water tank when humidification is performed.

2. The personal and portable humidifier type air cleaner according to claim 1, wherein as means configured to couple the vaporization kit and the wicks only when humidification is performed, a fan starting switch is turned on in a first-stage position while operating in conjunction with a tumbler in which a switch lever and a two-stage cam are formed, and the vaporization kit descends when the fan starting switch is turned on so that the moisture-containing filters and the wicks are coupled in a two-stage position.

3. The personal and portable humidifier type air cleaner according to claim 1, wherein the portable casing comprises:

an air intake port formed on one side of a straight-line shape casing having a rectangle internal space formed therein;

an air discharge port formed on the other side of the straight-line shape casing;

an air intake channel and an air discharge channel within the casing configured to form a consecutive straight-line shape; and rails formed in an inner wall of the straight-line shape casing in a length direction so that elements combined with the rails are inserted into and supported by the rails.

4. A water tank for a personal and portable humidifier type air cleaner, comprising:

wicks coupled to the water tank from an inside to an outside;

a stopper formed to input water to the inside of the water tank; and liquid supply means formed to input and supply liquid including an aroma or disinfection solution, to the inside of the water tank, wherein the liquid supply means is screwed onto a container for accommodating the liquid by a screw under the stopper, and wherein a bottom of the container is formed of a one-touch liquid supply device having a valve structure so that the liquid within the container externally flows whenever a button exposed at a top of the stopper is pressed.

* * * * *